US005315809A

United States Patent [19]

Gordon et al.

[11] Patent Number: 5,315,809

[45] Date of Patent: May 31, 1994

[54] STRETCH WRAPPING EMERGENCY STOP

[75] Inventors: Yoram Gordon; John Fain; William F. Davis; William G. Lancaster, all of Louisville, Ky.

[73] Assignee: Lantech, Inc., Louisville, Ky.

[21] Appl. No.: 943,235

[22] Filed: Sep. 11, 1992

[51] Int. Cl.[5] ..... B65B 13/04

[52] U.S. Cl. ..... 53/399; 53/441; 53/556; 53/587; 53/588

[58] Field of Search ..... 53/210, 211, 389.2, 53/399, 465, 587, 588, 441, 556; 188/30, 61, 82.1, 82.3, 82.74, 171

[56] References Cited

U.S. PATENT DOCUMENTS

| | | | |
|---|---|---|---|
| 2,546,081 | 3/1951 | Williams | 188/82.3 |
| 2,864,303 | 12/1958 | Brown et al. . | |
| 2,972,844 | 2/1961 | Ripley | 53/588 |
| 3,793,798 | 2/1974 | Lancaster, III et al. . | |
| 4,109,445 | 8/1978 | Shulman . | |
| 4,302,920 | 12/1981 | Lancaster et al. . | |
| 4,317,322 | 3/1982 | Lancaster et al. . | |
| 4,658,570 | 4/1987 | Thomas . | |
| 4,662,151 | 6/1987 | Mathes et al. . | |
| 4,722,170 | 2/1988 | Ball et al. . . | |
| 4,845,920 | 7/1989 | Lancaster . | |
| 4,858,415 | 8/1989 | Hake . | |
| 4,866,909 | 9/1989 | Lancaster, III et al. . | |
| 4,905,448 | 3/1990 | Plitt | 53/588 X |
| 5,042,225 | 8/1991 | Drury et al. | 53/211 |

*Primary Examiner*—John Sipos
*Assistant Examiner*—Linda B. Johnson
*Attorney, Agent, or Firm*—Finnegan, Henderson, Farabow, Garrett & Dunner

[57] ABSTRACT

A stretch wrapping machine includes a web dispenser and a rotatable support for providing relative rotation between the web dispenser and load to wrap a web of packaging material around the load. Cooperating engagement members are selectively and positively engageable with each other throughout the rotation of the rotatable support for stopping the rotation of the rotatable support when the engagement members are positively engaged and for permitting rotation of the rotatable support when the engagement members are disengaged. One of the engagement members is mounted on a rotatable support and the other is mounted on a fixed support. An actuator selectively engages engagement members. One engagement member preferably includes at least two stop units spaced at a distance less than the distance between the engageable formations of the other engagement member. A shock absorber is connected to one of the engagement members for decelerating the rotatable support when stopping the rotation of the rotatable support when the engagement members are engaged.

26 Claims, 9 Drawing Sheets

STRETCH WRAPPING EMERGENCY STOP

BACKGROUND OF THE INVENTION

1. Field of the Invention

The present invention relates to a stop mechanism for stretch wrapping machines which stops the movement of the load or the packaging material dispenser in response to a stopping command or signal.

2. Description of the Related Art

Stretch wrapping machines wrap a web of packaging material around a load by providing relative rotation between a web dispenser and the load. These wrapping machines may be structured in various arrangements to accommodate particular applications. U.S. Pat. Nos. 3,793,798, 4,317,322, 4,302,920, 4,109,445, 4,722,170, 4,858,415, 4,845,920 and 4,866,909 are incorporated herein by reference to illustrate a number of these arrangements.

In U.S. Pat. No. 3,793,798, U.S. Pat. No. 4,109,445 and U.S. Pat. No. 4,722,170, a web dispenser is supported on an arm which extends radially outward and downward from a vertical axis. The arm moves the dispenser in an orbital path about the vertical axis to wrap the load. In U.S. Pat. No. 4,845,920 and U.S. Pat. No. 4,858,415 the load is placed on a rotatable turntable. As the turntable rotates about a vertical axis, the load is wrapped with a web which is dispensed from a dispenser. In U.S. Pat. No. 4,866,909, the wrapping machine has a rotatable annular frame which carries the web dispenser in an orbital path about a horizontal axis to wrap a load.

In each of these arrangements, either the web dispenser or the load support is a relatively heavy inertial body which travels at substantial velocities. While various braking devices have been used in some applications to stop the rotating body, there is a need for a reliable stopping system which stops the rotating support for the web dispenser or load in a minimal stopping distance after detection of an obstruction in its path or other condition such as an emergency stop or power loss.

SUMMARY OF THE INVENTION

An object of the invention is to provide a reliable mechanism for stopping a web dispenser or load and their related structure at a minimum distance.

Another object of the invention is to provide a stop mechanism which is compact and relatively simple in construction so that the mechanism, in itself, does not present an obstacle to effective operation of the stretch wrapping machine.

Another object of the invention is to provide a stop mechanism which is fail safe, which is self-resetting, and not self-destructive in operation.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an apparatus for stretch wrapping a load with a web of packaging material. The apparatus includes a fixed support, a web dispenser, and a rotatable support for providing relative rotation between the web dispenser and the load to wrap the web of packaging material around the load. It also includes cooperating engagement members which are selectively and positively engageable with each other throughout the rotation of the rotatable support for stopping the rotation of the rotatable support when the engagement members are positively engaged and for permitting rotation of the rotatable support when the engagement members are disengaged. One of the engagement members is mounted on the rotatable support and the other mounted on the fixed support. The apparatus also includes an actuator for selectively engaging the engagement members.

The objects and purpose of the invention are further achieved when one engagement member includes a plurality of engageable formations, and the other engagement member includes at least two stop units spaced at a distance less than the distance between engageable formations, or an even multiple of that distance.

The objects and purpose of the invention are further accomplished by a shock absorber connected to one of the engagement members for decelerating the rotatable support when stopping the rotation of the rotatable support when the engagement members engage.

It is to be understood that both the foregoing genera description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF THE PREFERRED EMBODIMENT

Figure 1:
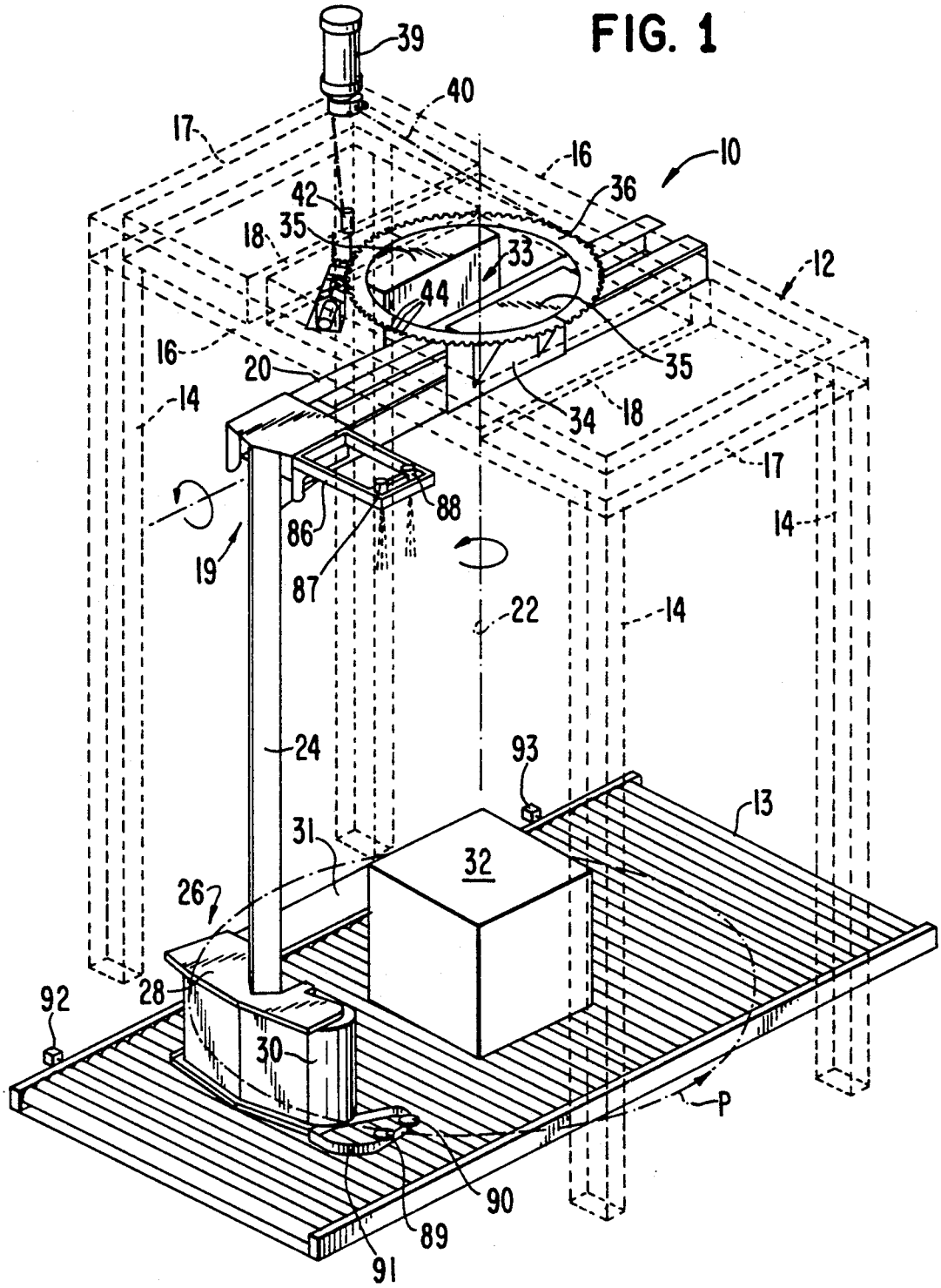
FIG. 1 is a perspective view showing an exemplary embodiment of a stretch wrapping machine incorporating the present invention.

Reference will now be made in detail to the present preferred embodiments of the invention, examples of which are illustrated in the accompanying drawings. Wherever possible, the same reference characters will be used throughout the drawings to refer to the same or like parts.

According to the present invention, there is provided an apparatus for stretch wrapping a load with a web of packaging material. The apparatus includes a fixed support, a web dispenser, and a rotating support for providing relative rotation between the web dispenser and the load to wrap the web packaging material around the load.

As shown in FIG. 1, the apparatus for stretch wrapping a load with a web of packaging material includes a stretch wrapping machine 10. The fixed support includes a fixed frame 12. Frame 12 includes standards 14, side members 16, end members 17 and spaced intermediate supporting beams 18 fixed to side members 16. The fixed support can be embodied in a variety of other ways and is not limited to a frame structure.

As shown in FIG. 1, the web dispenser includes a dispenser 26 which supports a supply roll of packaging material 30, such as a stretch wrap film web 31. Dispenser 26 may include a brake for restraining and stretching the film web 31 as it is wrapped on the load 32 supported by conveyor 13. Dispenser 26 may include a roll carriage 28 with interconnected pre-stretch rollers which rotate at different speeds to stretch the film web 31 before dispensing it on the load 32 such as shown in U.S. Pat. No. 4,845,920. It may also include a dancer bar or other arrangement to sense and regulate tension on the film web 31.

As shown in FIG. 1, the rotatable support includes an arm 19 comprising a radially extending horizontal beam 20 and a vertically extending column 24 which respectively extend radially outward and downward from a central vertical axis 22.

Figure 2:
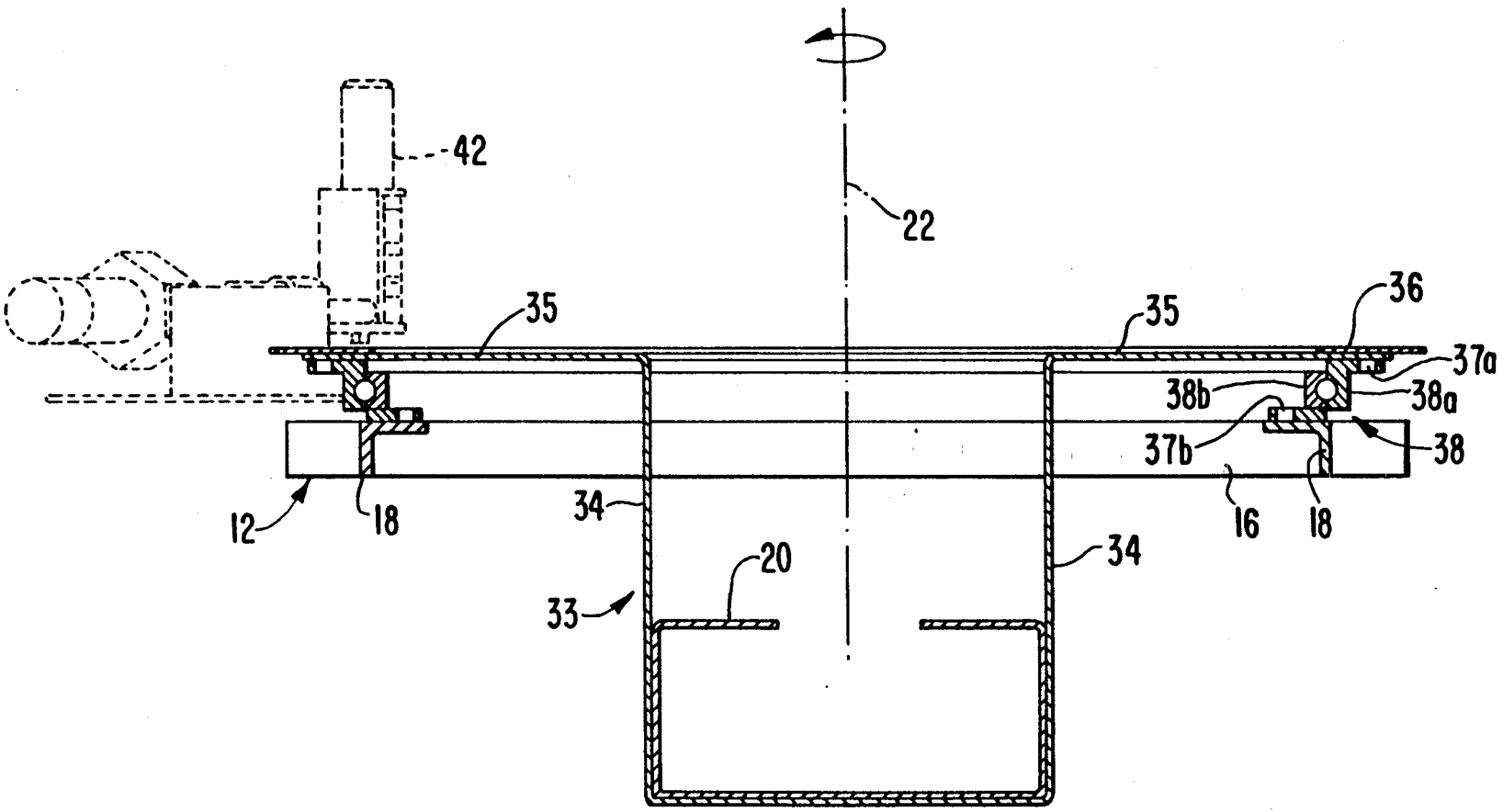
FIG. 2 is a schematic fragmentary cross section illustrating the support of rotatable components in the machine shown in FIG. 1.

As shown in FIG. 2, beam 20 is supported from the frame 12 by an upstanding bracket 33 having a pair of horizontal walls 34 joining with outwardly radiating flanges 35. The outer race 38*a* of bearing 38 is secured to the bottom of the flanges 35 by fasteners which pass through mounting holes 37*a*. The inner race 38*b* of bearing 38 is fixed to the frame at the beams 18 by fasteners which pass through mounting holes 37*b*, and also to the frame side members 16. As shown in FIG. 1, a drive motor 39 is mounted on the top of the frame 12 and is coupled by a drive belt 40 to the outer bearing 38 to rotatably drive arm 19 and dispenser 26 in an orbital path P concentric with the axis 22.

It is possible to provide an arrangement that permits the elevation of dispenser 26 to be adjusted on the column 24 during such relative movement of the dispenser 26 and the load 32, so that the film web 31 will be applied to the full height of the load 32 in generally spiral fashion. This operation is described in more detail in U.S. Pat. Nos. 3,793,798; 4,109,445; and 4,722,170.

According to the present invention, there is provided cooperating engagement members which are selectively and positively engageable with each other throughout the rotation of the rotatable support. The cooperating engagement members stop the rotation of the rotatable support when the engagement members are positively engaged, and permit rotation of the rotatable support when the engagement members are disengaged. One of the engagement members is mounted on the rotatable support and the other is mounted on the fixed support.

Figure 3:
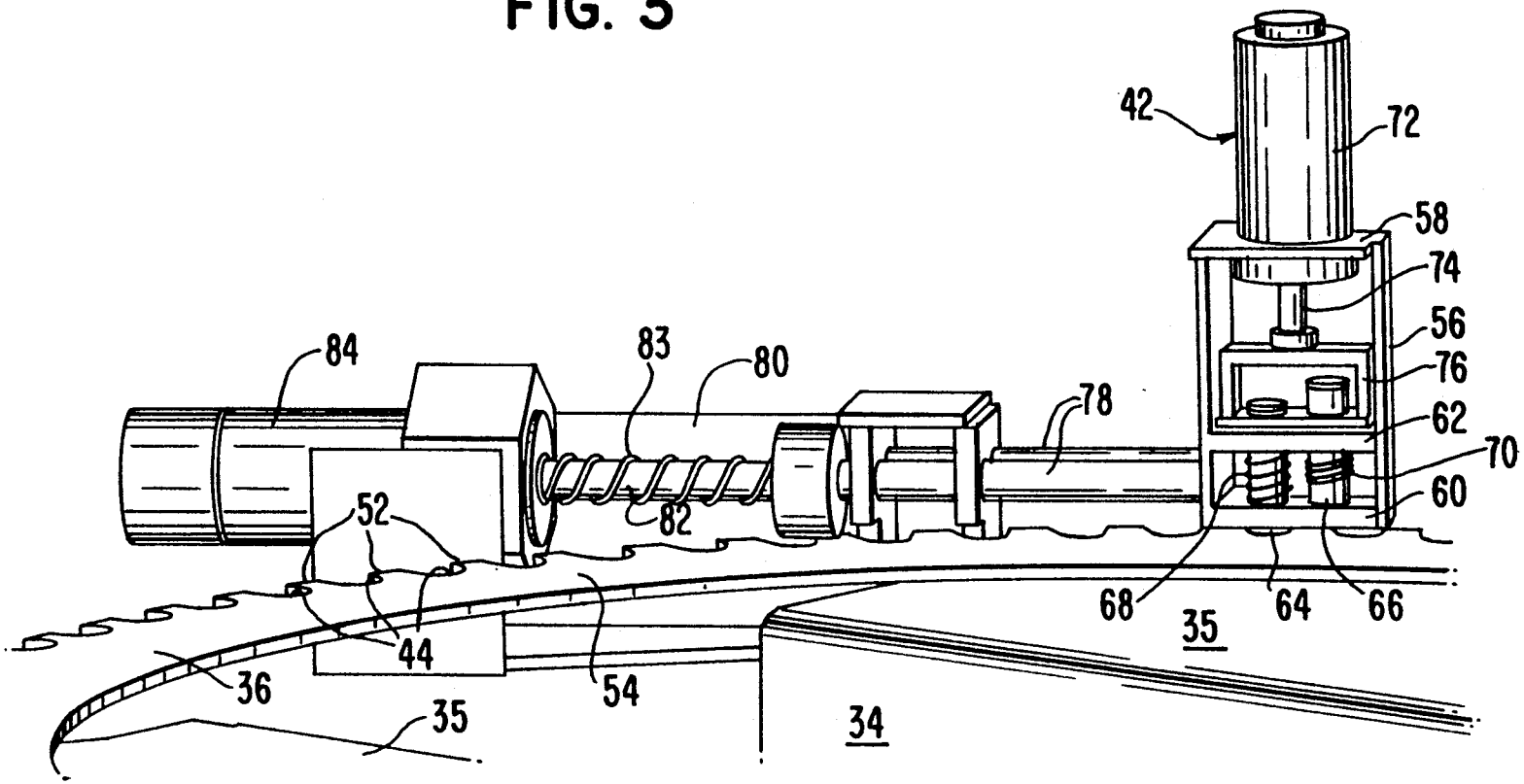
FIG. 3 is a fragmentary isometric view of a portion of FIG. 1 from a first perspective.
Figure 4:
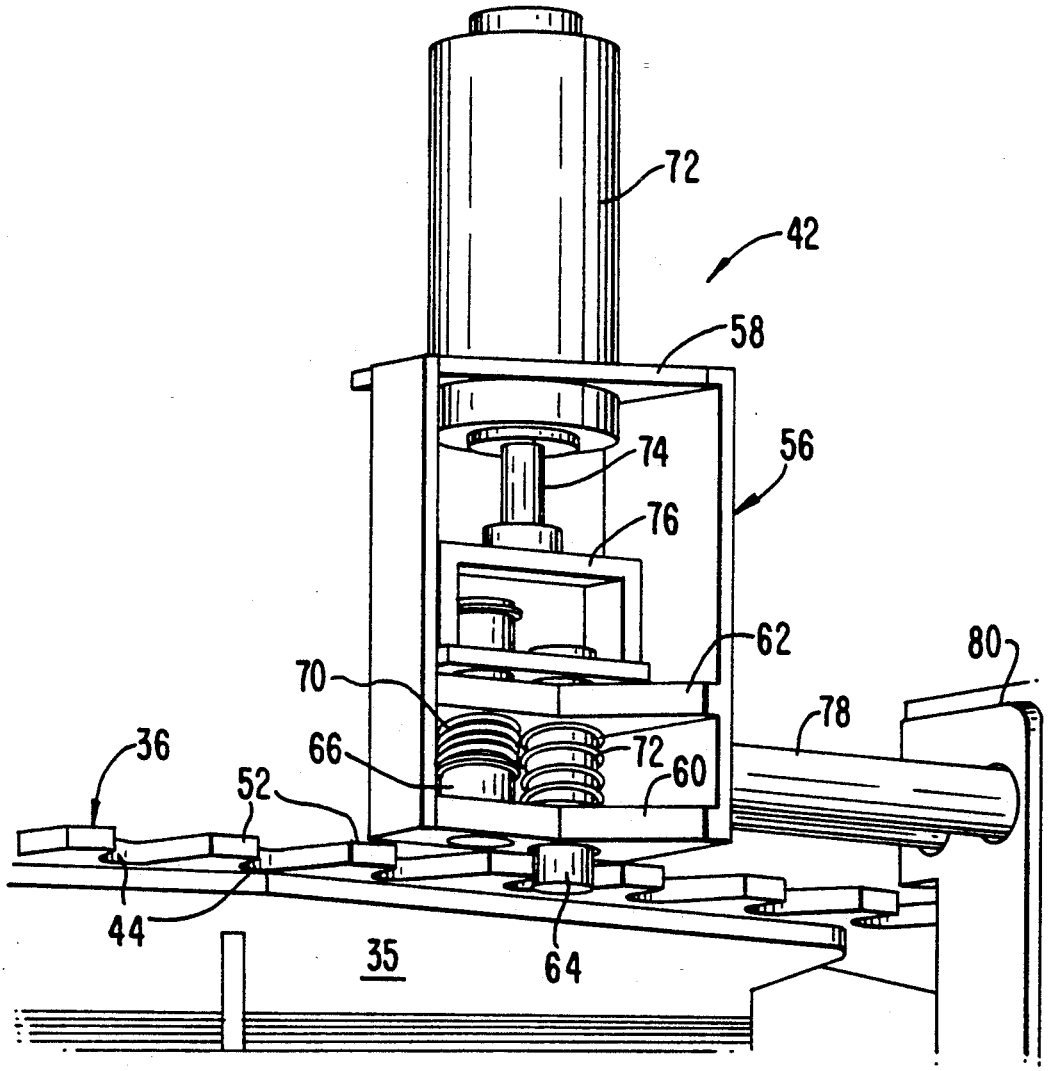
FIG. 4 is a fragmentary isometric view of a portion of FIG. 1 from a second perspective.

As shown in FIGS. 2, 3 and 4, one of the cooperating engagement members is a control ring 36 having a circular sprocket shape including a plurality of uniformly spaced engageable formations 44. Control ring 36 is mounted on flanges 35.

In the illustrated embodiment, the formations 44 are defined by the recessed root portions lying between projecting teeth 52 on the periphery of the control ring 36. The engageable member or control member embodied by control ring 36 is not limited to the arrangement in FIG. 3. Rather, an alternative embodiment may be employed, such as a flat ring with holes, a plate with a series of raised areas on an axial surface or similar arrangements.

As shown in FIGS. 2, 3 and 4, the other engagement member includes a stop mechanism 42. Stop mechanism 42 preferably includes at least two stop units such as pins 64 and 66 which are movable relative to each other and mounted in a frame 56. Frame 56 is connected to a linkage which is mounted on frame 16 so that pins 64 and 66 are near the periphery of control ring 36.

Frame 56 includes a top plate 58, a bottom plate 60 and a central plate 62. The bottom and central plates, 60 and 62, are apertured to receive pins 64 and 66 for axial movement between upper retracted positions and lower extended positions. Pins 64 and 66 are biased independently by respective springs 68 and 70 toward their respective lower extended positions. Pins 64 and 66 are supported to be alignable with the engageable formations 44 on the control ring 36 so as to engage the engageable formations 44 on the control ring 36 throughout the rotation of the rotatable support. This allows the rotation of the rotatable support to be stopped at an point in its path of travel around the load.

The pins 64 and 66 preferably are spaced from each other by a distance which is less than the distance between the spaced engageable formations 44, or a distance which is a non-fractional multiple of a distance less than the distance between the spaced engageable formations 44 so that both pin units do not engage formations 44 at the same time. If there are two pins, it is preferable that the pins are spaced at a distance at about one half of the distance between the engageable formations or a distance which is a non-fractional multiple of about one-half of the distance between the engageable formations. Such a spacing would be, for example, $\frac{1}{2}$, $1\frac{1}{2}$, $2\frac{1}{2}$, $3\frac{1}{2}$ times the distance between the engageable formations. If there are more than two pins, their positions are preferably chosen so that engagement similarly occurs as soon as possible after actuation.

As a result, the spacing of the engageable formations 44 on control ring 36 can be adequately large to provide sufficient strength of material between the formations. The pitch of the formations is, therefore, limited by the strength-of-material considerations. The provision of the two pins at spaced increments less than the spacing of the engageable formations 44 increases the effective pitch of the stop mechanism 42. Since both pins 64 and 66 are advanced toward the control ring 36 simultaneously, either one or the other of the pins 64 or 66 will more readily engage in a formation 44 to initiate the stopping operation.

Figure 8:
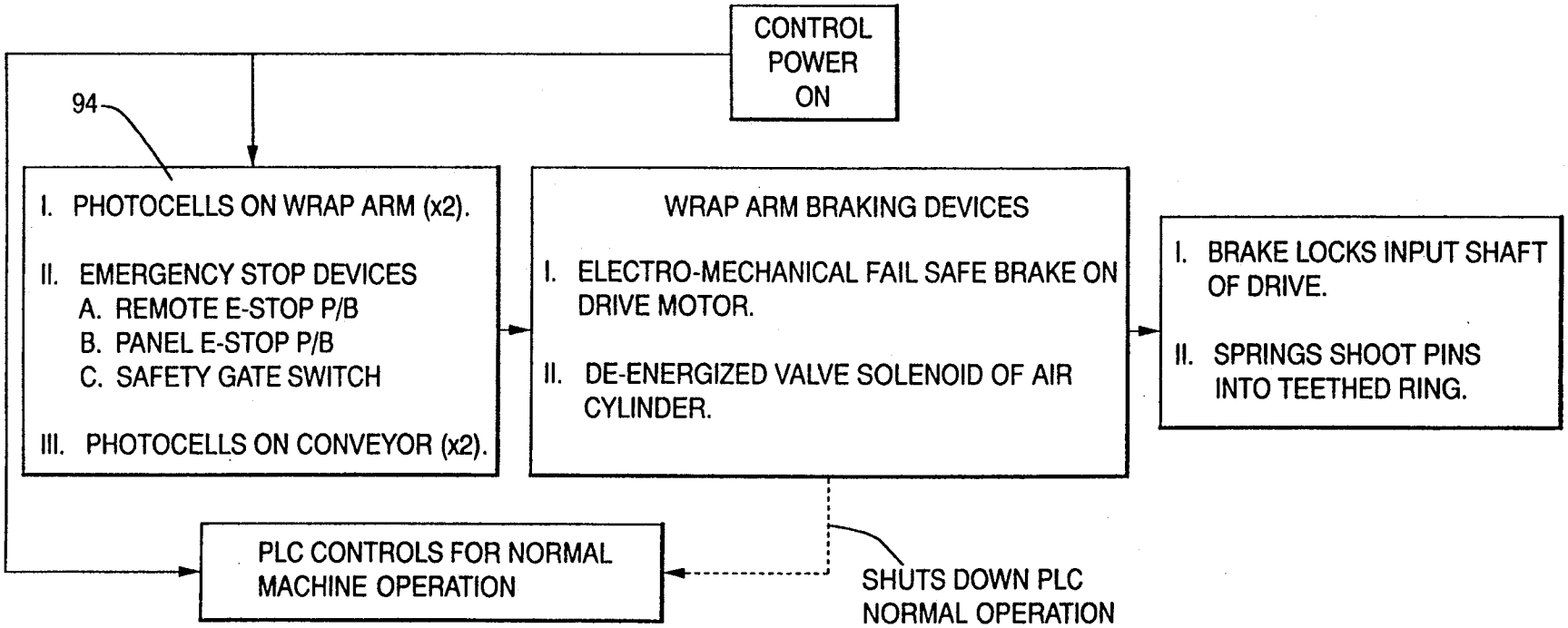
FIG. 8 is a schematic block diagram showing an exemplary control system for the apparatus of the invention.

According to the present invention, there is provided an actuator for selectively engaging the engagement members. As shown in FIGS. 3, 4 and 8, the actuator includes an air cylinder 72 which is responsive to a control signal.

Air cylinder 72 is fixed to the top wall 58 of the support member 56 and includes a depending piston rod 74 which is secured to a pin lifting frame 76. The pins 64 and 66 extend through apertures in the bottom of the frame 76 and are prevented from downward passage through the bottom of the frame 76 by enlarged heads, C-clips, or the like at the top of each pin. Thus upward movement of the frame 76 by the cylinder 72 will lift both pins 64 and 66 against the bias of the springs 68 and 70, respectively, to their retracted positions. Correspondingly, de-energization of cylinder 72 actuates movement of the lifting frame 76 downwardly to allow both pins 64 and 66 to move to their extended positions independently of each other under the bias of their respective springs 68 and 70.

The stop mechanism 42 is supported by attachment of the frame 56 to a pair of guide rods 78 which extend slidably into a receiver 80. In the illustrated embodiment, receiver 80 is secured to the fixed frame 12 of the wrapping machine 10. The guide rods 78 and the receiver 80 are thus aligned to be generally tangential to the outer periphery of the control ring 36. The guide rods 78 abut against a plunger 82 forming part of a shock absorber which includes a spring 83 and an hydraulic cylinder 84 fixed to the receiver 80 in the illustrated embodiment. The shock absorber is connected to stop mechanism 42 to decelerate the rotatable support of arm 19 when stopping the rotation of the rotatable support when the stop mechanism 42 and control ring 36 engage. Other shock absorbing devices can also be used.

In accordance with another feature of the invention, the rotatable support deflects over a deflection distance relative to the engagement member which is mounted to it when the engagement members engage, and the shock absorber decelerates the engagement member mounted on the rotatable support over an absorption distance when the engagement members engage, so that the maximum deflection distance preferably occurs at less than the absorption distance and is minimized at the end of the absorption distance. It is preferable that the maximum deflection distance occurs at approximately one half the absorption distance. It also is preferable that the maximum travel of the rotatable support is not greater than the absorption distance.

In accordance with the features of the invention, the stroke of the shock absorber 84 is determined theoretically or experimentally, based on values of parameters such as the deflection of the dispenser 26 relative to the control ring 36 due to the spring effect in bending of column 24, the twisting yieldability of the beam 20, tolerances in the bearing 38, and the natural frequency of the weight of the dispenser 26 in the embodiment of FIG. 1.

Figure 5:
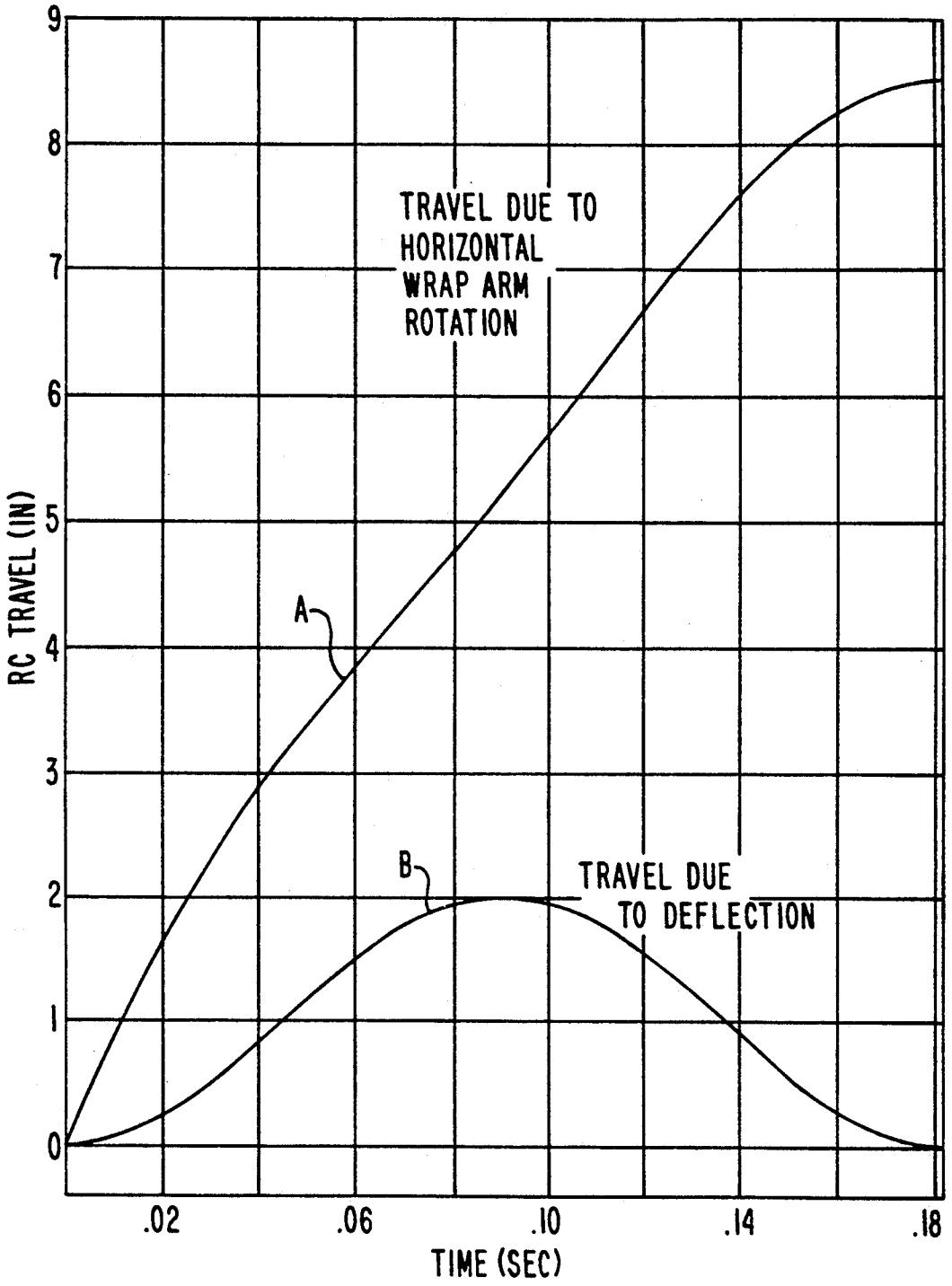
FIG. 5 is a graph illustrating characteristics of travel and time for a stop mechanism incorporating the present invention.

As shown in FIG. 5, Curve A represents travel per unit time, according to the invention, of the pins 64, 66 and the control ring 36 after one of the pins 64 and 66 engage with a formation 44 to decelerate the rotatable components to a stop. Curve B in FIG. 5 represents travel, according to the invention, of the dispensing unit 26 in the machine 10 due to deflection parameters indicated above.

As seen in the graph of FIG. 5, the maximum deflection distance is set to occur at less than the absorption distance and preferentially is set to occur at approximately one half of the absorption distance. It is also seen that in this preferential arrangement, the deflection distance is at or near a minimum at the end of the absorption distance.

Figure 6:
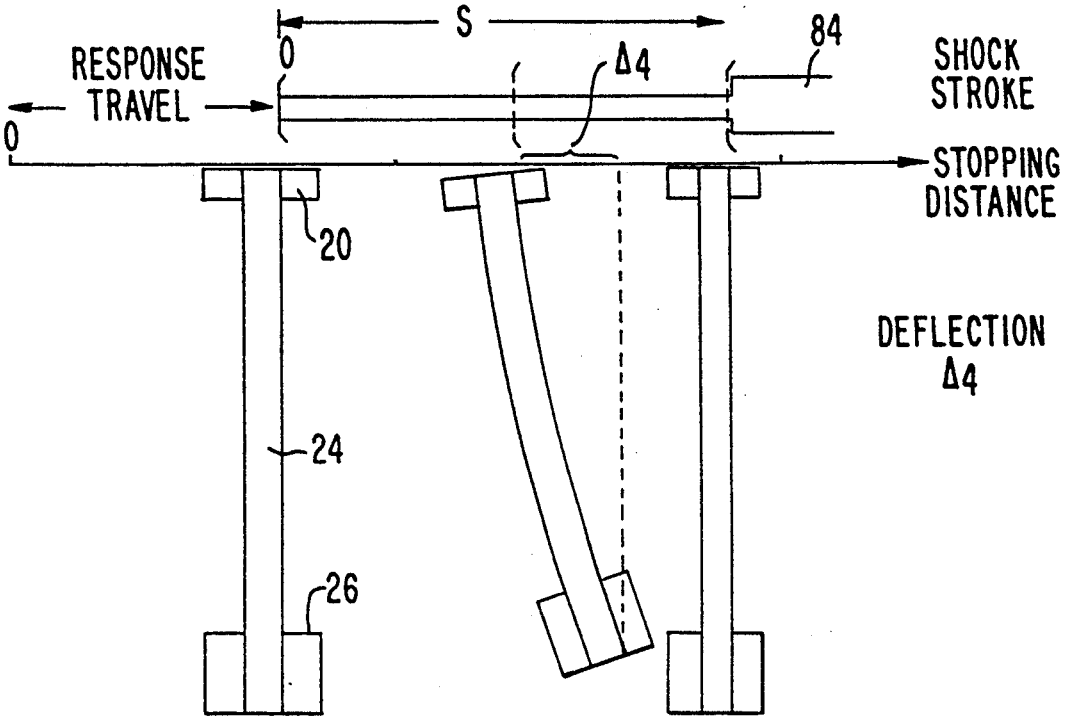
FIG. 6 is a schematic illustration depicting operation of a stop mechanism of the invention embodied in FIG. 1.
Figure 7:
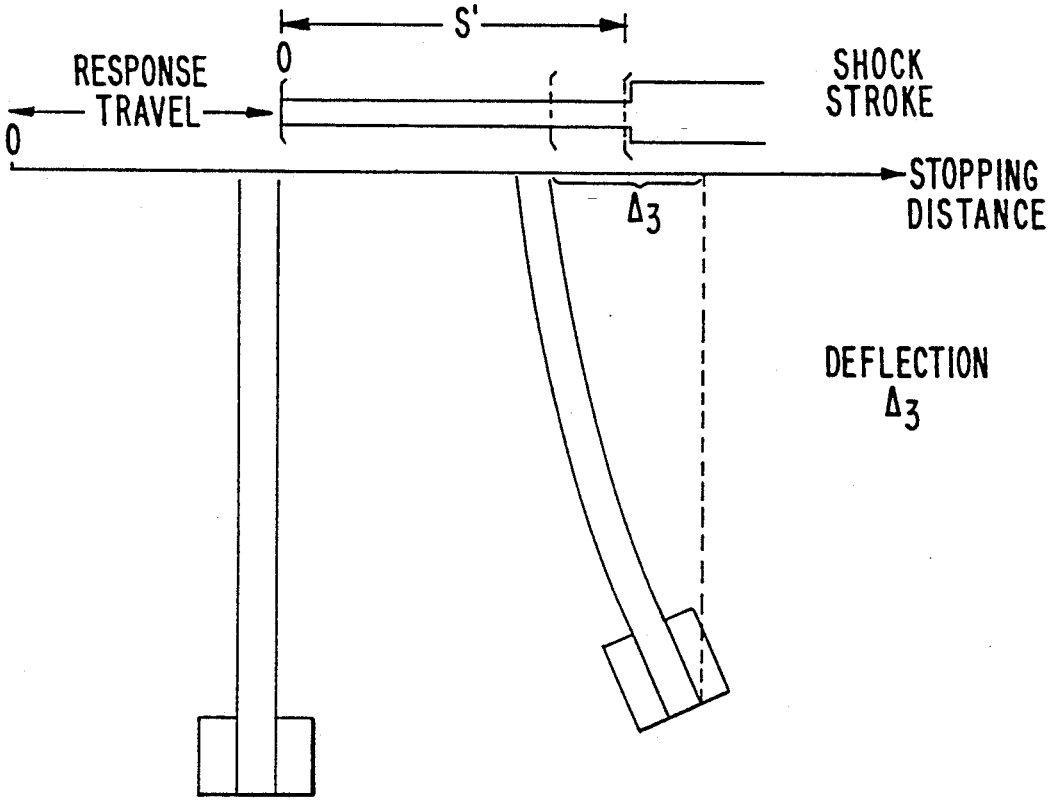
FIG. 7 is a schematic illustration, similar to FIG. 6, but illustrating a comparative example.

The behavior of the components depicted by the graph of FIG. 5 is further illustrated graphically comparing in FIGS. 6 and 7 of the drawings. As shown in FIG. 6, as the beam 20, column 24 and dispenser 26 begin to stop, the dispenser end of the column 24 undergoes deflection relative to the control ring 36. The maximum deflection is at the distance of ½ S, namely at one half of the absorption distance of shock absorber stroke S. The deflection is at or near a minimum at the distance S, namely the end of the absorption distance of shock absorber stroke S. The maximum travel of the rotatable support is not greater than the absorption distance S.

In accordance with the present invention, the stroke S of the shock absorber 84, as represented schematically in FIG. 6, is preferably at least as long and even more preferably as long as the distance required for the dispenser 26 to come to a full stop after deflection.

In FIG. 7, a comparative example is given, where a shorter stroke of the shock absorber 84 is represented by the dimension S'. While the stopping distance as governed by the shock absorber 84 is decreased in FIG. 7, the actual travel of the dispenser 26 after deceleration is initiated is greater than that of FIG. 6 due to the deflection of the dispenser relative to the control ring.

Accordingly, the stroke of the shock absorber 18, in accordance with the present invention, is preferably at least as great as maximum travel of the dispenser 26 due to deflection of components on which it is supported.

In accordance with another feature of the invention a sensor is mounted to rotate with the rotatable support and web dispenser for actuating the actuator responsive to an obstruction in the path of the rotatable support and web dispenser. The sensor is positioned sufficiently ahead of the rotatable support and web dispenser such that the rotatable support and web dispenser are stopped before hitting the obstruction. As shown in FIG. 1, the sensor includes photodetectors 89 and 90, and illumination sources 87 and 88.

Machine 10 includes a support 86 extending in the leading direction of travel of the dispenser 26 in the orbital path P. The support 86 carries a pair of illumination sources 87 and 88 to emit light in a downward direction to a pair of photodetectors 89 and 90 supported on a bracket 91 mounted at the base of the dispenser 26 in the leading direction of dispenser travel. Due to this arrangement of light sources and photocells, the presence of an object in the light beams will develop a signal at the one of the photocells 89 and 90. Similar light beam sources 92 and 93 may be arranged on the conveyor 13 on opposite sides of the orbital path P travelled by the dispenser 26 in operation of the machine 10. The light sources 92 cooperate with photodetectors (not shown), on opposite sides of the conveyor 13 in the same manner as the light beam sources 87, 88 and the photodetectors 89, 90.

The photodetectors thus identified in FIG. 1 are incorporated in a power fail-safe control system for the machine 10 as represented schematically in block diagram form in FIG. 8 of the drawings. As shown in FIG. 8, with control power on, the controls for normal machine operation are enabled as are the photocells 89, 90 and those (not shown) associated with the light sources 92, 93 on the conveyor 13. The photodetectors are identified by I and III respectively in the block 94. Other emergency stop devices identified by the numeral II, such as a remote emergency stop push button, a panel emergency stop push button, and a safety gate switch are enabled when the control power is on.

Upon the signal of any of the emergency stop devices represented by the block 94, a fail safe brake (not shown) on the drive motor 39 is de-energized simultaneously with de-energization of the air cylinder 72 on the stop mechanism 42. The latter operation actuates the stop unit 42 to release the pins 64 and 66. One of pins 64 and 66 will engage one of the engageable formations 44 on the control ring 36 to initiate stopping movement of the dispenser 26. The PLC control for normal machine operation is shut down simultaneously with the aforementioned operation of the air cylinder 72. While such a fail-safe control operation is preferred, the invention also contemplates the reverse control operation of driving the stop pins down when an air cylinder or other actuator is energized.

Figure 9:
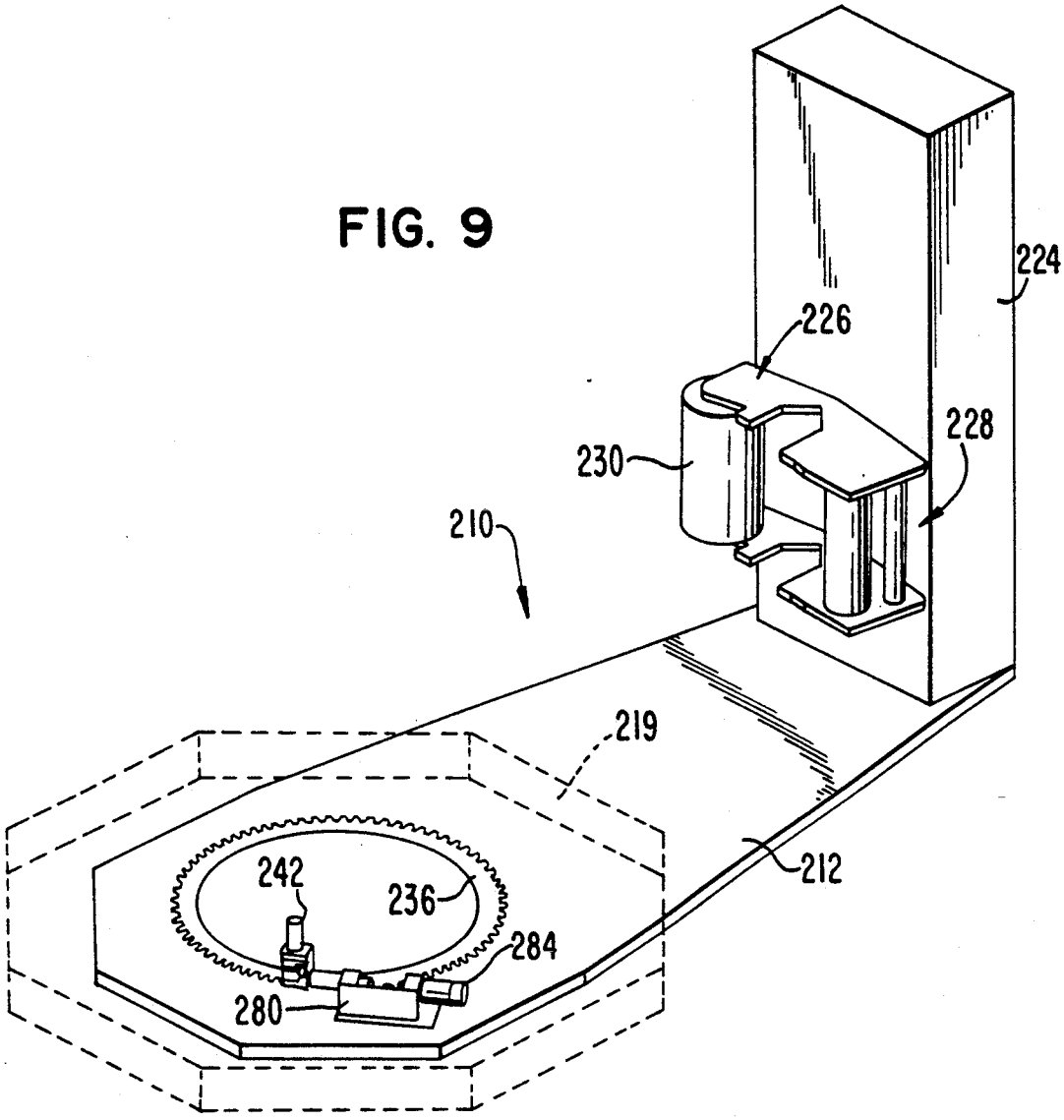
FIG. 9 is a schematic perspective view showing an alternative embodiment of a stretch wrapping machine incorporating the present invention.

In FIG. 9 of the drawings, an alternative embodiment of the present invention is illustrated as a stretch wrapping machine 210. The wrapping machine 210 in FIG. 9 is of a type similar to those disclosed in U.S. Pat. No. 4,845,920 and U.S. Pat. No. 4,858,415.

In this embodiment, the rotatable support includes a turntable 219 for rotation relative to a fixed support such as a frame 212 on which a dispenser 226 is mounted. The arrangement may employ a bearing arrangement (not shown), but similar to that illustrated in FIG. 2, where the bracket 33 is inverted with respect to the control ring 236 to support the turntable 219 in an elevated position above the ring 236. The wrapping material dispenser 226 in this embodiment is supported on a vertical column 224 which is part of frame 212. In the machine 210, the turntable 219 supports a load to be wrapped and is driven in rotation relative to the dispenser 226.

A stop mechanism 242, substantially identical to that described above with reference to FIGS. 3 and 4, is supported by a receiver 280 fixed to the frame 212 and is associated with a shock absorber 284 to provide an assembly identical to that described with reference to FIGS. 3 and 4. The operation of the stop mechanism 242 to interrupt rotation of the turntable 213 is identical to that previously described.

Figure 10:
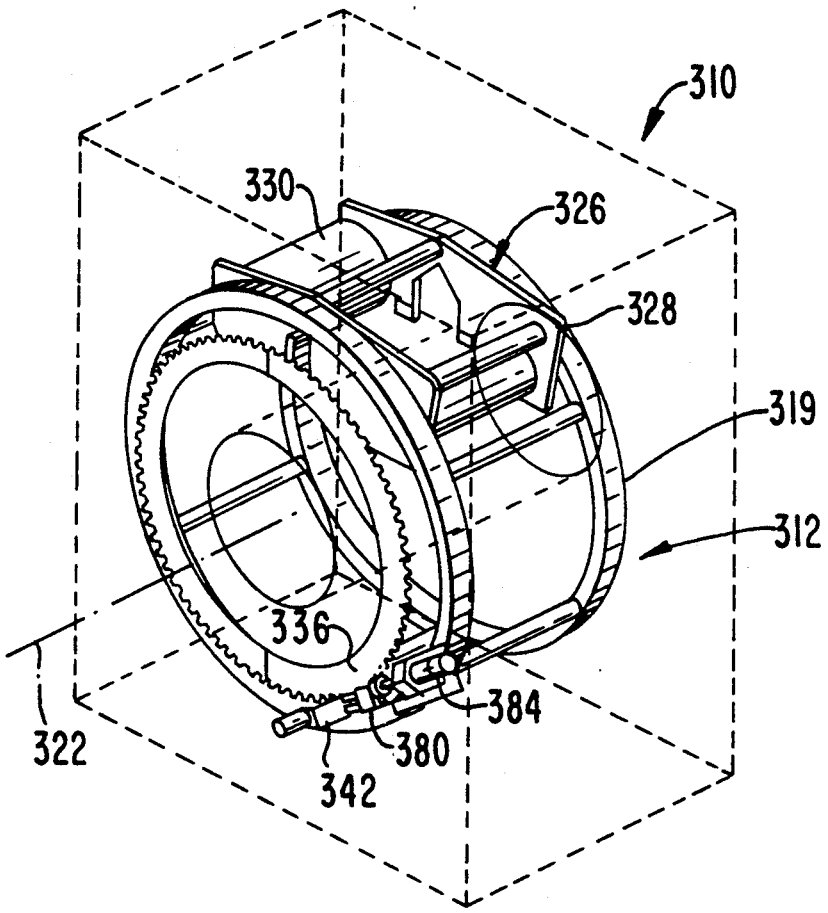
FIG. 10 is a schematic perspective view illustrating another alternative embodiment of a stretch wrapping machine incorporating the present invention.

In FIG. 10, a further embodiment of the present invention is represented by a wrapping machine 310. The machine 310 is of a type disclosed in U.S. Pat. No. 4,866,909.

In this embodiment, the fixed support includes a fixed frame 312 with a bearing ring, and the rotatable support includes an annular rotatable frame 319 with a cooperating bearing ring. Rotatable frame 319 supports a wrapping material dispenser 326 for rotation about a central horizontal axis 322. A control ring 336 is rotatable with the dispenser 326 relative to the frame 312. A product to be wrapped is fed centrally along the axis 322 and retained against rotation. Orbital movement of the dispenser 326 about the interior of the annular frame 312 results in the wrapping operation previously described, but on a horizontal axis.

The machine 310 includes a stop mechanism 342 co-operable with engageable formations on the ring 336 and includes the same organization of a receiver fixed to the frame 312 and a shock absorber 384.

It will be apparent to those skilled in the art that various modifications and variations can be made in the wrapping machine of the present invention and in construction of the emergency stop mechanism thereof without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. An apparatus for stretch wrapping a load with a web of packaging material, the apparatus comprising:

a fixed support;

a web dispenser;

a rotatable support for providing relative rotation between the web dispenser and the load to enable wrapping of the web of packaging material around the load;

cooperating engagement members configured to be selectively and positively engageable with each other throughout rotation of the rotatable support for stopping the rotation of the rotatable support when the engagement members are positively engaged and for permitting rotation of the rotatable support when the engagement members are disengaged, one of the engagement members mounted on the rotatable support and the other engagement member mounted on the fixed support;

an actuator for selectively engaging the engagement members with each other; and a shock absorbing device operatively connected to one of the engagement members for decelerating the rotatable support to assist in stopping the rotation of the rotatable support when the engagement members engage.

2. The apparatus of claim 1, wherein one of the engagement members includes a plurality of engageable formations spaced a predetermined distance from each other, and the other engagement member includes at least two stop units which are moveable relative to each other for independently engaging the spaced engageable formations, the stop units spaced from each other by a separation distance which is less than the predetermined distance between each of the plurality of spaced engageable formations.

3. The apparatus of claim 1, wherein one of the engagement members includes a plurality of engageable formations spaced a predetermined distance from each other, and the other engagement member includes at least two stop units which are moveable relative to each other for independently engaging the spaced engageable formations, the stop units being spaced from each other by a separation distance which is equivalent to a non-fractional multiple of a distance less than the predetermined distance between each of the plurality of spaced engageable formations.

4. The apparatus of claim 2, wherein the stop units are spaced from each other by a separation distance equivalent to about one half of the predetermined distance between each of the plurality of spaced engageable formations.

5. The apparatus of claim 3, wherein the stop units are spaced from each other by a separation distance which is equivalent to an even multiple of about one half of the predetermined distance between the each of the plurality of spaced engageable formations.

6. The apparatus of claim 2, wherein the one engageable member having the plurality of spaced engageable formations is mounted on the rotatable support and the other engageable member having the at least two stop units is mounted on the fixed support.

7. The apparatus of claim 1, wherein one of the engagement members has a circular sprocket shape.

8. The apparatus of claim 1, wherein the rotatable support supports the load.

9. The apparatus of claim 1, wherein the rotatable support supports the web dispenser.

10. The apparatus of claim 9, wherein the rotatable support includes an arm which extends radially outward and downward from a central vertical axis, and the web dispenser is mounted on the arm.

11. The apparatus of claim 10, wherein the arm includes a radially extending horizontal beam and a vertically extending column, and the web dispenser is mounted on the column.

12. The apparatus of claim 1, wherein one of the engagement members includes a plurality of engageable formations spaced a predetermined distance from each other, and the other engagement member includes at least two stop units which are independently moveable relative to each other and biased toward engagement with the spaced engageable formations of the one engagement member, and further wherein the actuator is configured to release the at least two stop units for independent movement toward the spaced engageable formations of the one engageable member, the stop units spaced from each other by a separation distance to permit one of the stop units to positively engage one of the spaced engageable formations, while another of the stop units contacts the spaced engageable formations of the one engagement member but does not positively engage an engageable formation.

13. The apparatus of claim 1, wherein the rotatable support deflects over a deflection distance relative to the engagement members when the engagement members engage, and the shock absorbing device decelerates the engagement members over a total absorption distance when the engagement members engage so that the deflection distance incurred by the rotatable support reaches a maximum value at a distance less than the total absorption distance of the shock absorbing device, and the deflection distance incurred by the rotatable support approaches a minimized value when the total absorption distance of the shock absorbing device is reached.

14. The apparatus of claim 1, wherein the rotatable support includes an arm which extends radially outward and downward from a central vertical axis, the web dispenser is mounted on the arm, and the rotatable support deflects over a deflection distance relative to the engagement members when the engagement members engage, and further wherein the shock absorbing device decelerates the engagement members over a total absorption distance when the engagement members engage so that the deflection distance incurred by the rotatable support reaches a maximum value at a distance less than the total absorption distance of the shock absorbing device, and the deflection minimized value when the total absorption distance of the shock absorbing device is reached.

15. The apparatus of claim 1, wherein the rotatable support deflects over a deflection distance relative to the engagement members when the engagement members engage, and the shock absorbing device decelerates the engagement members over a total absorption distance when the engagement members engage so that the deflection distance incurred by the rotatable support reaches a maximum value at a distance less than the total absorption distance of the shock absorbing device, and the deflection distance incurred by the rotatable support approaches a minimum value when the total absorption distance is reached.

16. The apparatus of claim 10, including a sensor mounted to rotate with the rotatable support and web dispenser, the sensor operatively communicating with the actuator for actuating the actuator responsive to an obstruction in a path traveled by the rotatable support and web dispenser, and further wherein the sensor is positioned sufficiently ahead of the rotatable support and web dispenser to enable stopping of the rotatable support and web dispenser before hitting the obstruction.

17. A process for quickly stopping rotation of a rotatable support relative a fixed support, wherein the rotatable support provides relative rotation between a web dispenser and a load to stretch wrap the load with a web of packaging material, the process comprising the steps of:

engaging cooperating engagement members which are respectively located on the fixed support and the rotatable support so that the engagement members move together when in engagement; and decelerating the engagement members over a total absorption distance by a shock absorbing device operatively connected to one of the engagement members when the engagement members are engaged, thereby deflecting the rotatable support over a deflection distance relative to the engagement members when the engagement members engage so that the deflection distance incurred by the rotatable member reaches a maximum value at a distance less than the total absorption distance of the shock absorbing device, and the deflection distance incurred by the rotatable member approaches a minimum value when the total absorption distance of the shock absorbing device is reached.

18. The process of claim 17, wherein the decelerating step includes decelerating the engagement members so that the deflection distance incurred by the rotatable member reaches a maximum value at a distance of approximately one half the total absorption distance of the shock absorbing device.

19. The process of claim 17, further including the step of providing the rotatable support with an arm which extends radially outward and downward from a central vertical axis, wherein the web dispenser is mounted on the arm.

20. A process for quickly stopping the rotation of a rotatable support relative a fixed support, wherein the rotatable support provides relative rotation between a web dispenser and a load to stretch wrap the load with a web of packaging material, the process comprising the steps of:

engaging cooperating engagement members which are respectively located on the fixed support and the rotatable support so that the engagement members move together when in engagement; and decelerating the engagement members over a total absorption distance by a shock absorbing device operatively connected to one of the engagement members when the engagement members are engaged, thereby deflecting the rotatable support over a deflection distance relative to the engagement members when the engagement members engage so that the deflection distance incurred by the rotatable member reaches a maximum value at a distance of approximately one half the total absorption distance of the shock absorbing device.

21. The process of claim 20, further including the step of providing the rotatable support with an arm which extends radially outward and downward from a central vertical axis, wherein the web dispenser is mounted on the arm.

22. A process for quickly stopping the rotation of a rotatable support relative a fixed support, wherein the rotatable support provides relative rotation between a web dispenser and a load to stretch wrap the load with a web of packaging material, the processing comprising the steps of:

engaging cooperating engagement members which are respectively located on the fixed support and the rotatable support so that the engagement members move together when in engagement; and decelerating the engagement members over a total absorption distance by a shock absorbing device operatively connected to one of the engagement members when the engagement members are engaged, thereby deflecting the rotatable support over a deflection distance relative to the engagement members when the engagement members engage so that the deflection distance incurred by the rotatable member reaches a maximum value at a distance less than the total absorption distance of the shock absorbing device, and further wherein total travel of the rotatable support after the engagement members engage is not greater than the total absorption distance of the shock absorbing device.

23. The process of claim 22, further including the step of providing the rotatable support with an arm which extends radially outward and downward from a central vertical axis, wherein the web dispenser is mounted on the arm.

24. The apparatus of claim 1, wherein the rotatable support includes an arm which extends radially outward and downward from a central vertical axis, with the web dispenser mounted on the arm; the rotatable support deflects over a deflection distance relative to the engagement members when the engagement members engage, and the shock absorbing device decelerates the engagement members over a total absorption distance when the engagement members engage; and further wherein the deflection distance incurred by the rotatable support reaches a maximum value at a distance less than the total absorption distance of the shock absorbing device, and the deflection distance incurred by the rotatable support approaches a minimum value when the total absorption distance of the shock absorbing device is reached.

25. The apparatus of claim 1, wherein the rotatable support deflects over a deflection distance relative to the engagement members when the engagement members engage; and the shock absorbing device decelerates the engagement members over a total absorption distance when the engagement members engage, and further wherein the deflection distance incurred by the rotatable support reaches a maximum value at a distance of approximately one half the total absorption distance of the shock absorbing device.

26. The apparatus of claim 1, wherein the rotatable support includes an arm which extends radially outward and downward from a central vertical axis, with the web dispenser mounted on the arm; the rotatable support deflects over a deflection distance relative to the engagement members when the engagement members engage, and the shock absorbing device decelerates the engagement members over a total absorption distance when the engagement members engage; and further wherein the deflection distance incurred by the rotatable support reaches a maximum value at a distance of approximately one half the total absorption distance of the shock absorbing device.

* * * * *

UNITED STATES PATENT AND TRADEMARK OFFICE

CERTIFICATE OF CORRECTION

PATENT NO. : 5,315,809
DATED : May 31, 1994
INVENTOR(S) : YORAM GORDON et al.

It is certified that error appears in the above-indentified patent and that said Letters Patent is hereby corrected as shown below:

Claim 14, col. 9, line 60, after "deflection" insert --distance incurred by the rotatable support approaches a--.

Signed and Sealed this

Sixteenth Day of August, 1994

Bruce Lehman

*Attest:*

BRUCE LEHMAN

*Attesting Officer*

*Commissioner of Patents and Trademarks*